United States Patent [19]

Kakinaka

[11] 4,095,621

[45] Jun. 20, 1978

[54] WOOF BREAKAGE DETECTION SYSTEM FOR A SHUTTLELESS WEAVING MACHINE

[75] Inventor: Arao Kakinaka, Nishinomiya, Japan

[73] Assignee: Kasuga Denki Co., Ltd., Osaka, Japan

[21] Appl. No.: 767,615

[22] Filed: Feb. 10, 1977

[30] Foreign Application Priority Data

Feb. 17, 1976 Japan ..... 51-16085

[51] Int. Cl.[2] ..... D03D 51/34

[52] U.S. Cl. ..... 139/370.2

[58] Field of Search ..... 139/341, 370.1, 370.2; 340/259; 66/163; 28/51; 57/81

[56] References Cited

U.S. PATENT DOCUMENTS

| | | | |
|---|---|---|---|
| 3,298,401 | 1/1967 | Stutz | 139/370.1 |
| 3,440,634 | 4/1969 | Maurmann et al. | 139/370.2 |
| 3,495,633 | 2/1970 | Sakamoto et al. | 139/370.2 |
| 4,023,599 | 5/1977 | Zeleny | 139/370.2 |

*Primary Examiner*—Henry S. Jaudon
*Attorney, Agent, or Firm*—Staas & Halsey

[57] ABSTRACT

A system for detecting the breaking of the woof in a shuttleless weaving machine wherein the woof is drawn into the machine from a supply. The system includes a detector circuit for detecting the travel of the woof into the machine, and generating a signal when the woof breaks, indicative thereof; a timing switch operatively associated with the weaving cycle of the weaving machine for generating a timing signal at a predetermined time period during the travel of said woof with respect to the detector; a monostable multivibrator responsive to the leading edge of the timing signal, gate means responsive to the timing signal and the output from said monostable multivibrator for providing a time period defining signal; second gate means for allowing the woof breaking signal to pass therethrough as a function of being ANDED with the timing period defining signal; a flip-flop being set in response to the output from the second gate means; and a relay which is energized by the set output from the flip-flop, for disconnecting power from the weaving machine.

16 Claims, 6 Drawing Figures

FIG. 2a
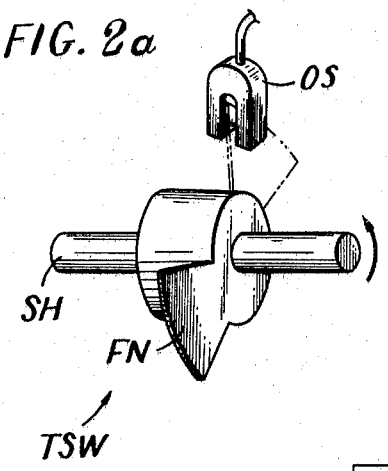
FIG. 2b
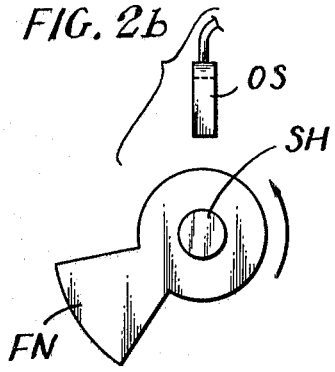
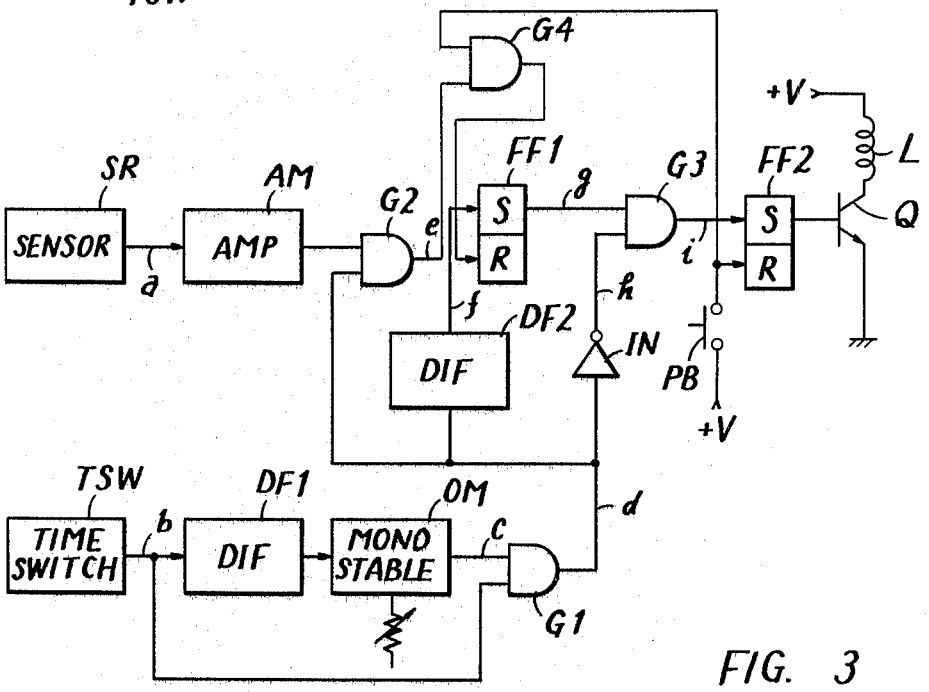
FIG. 3

FIG. 4
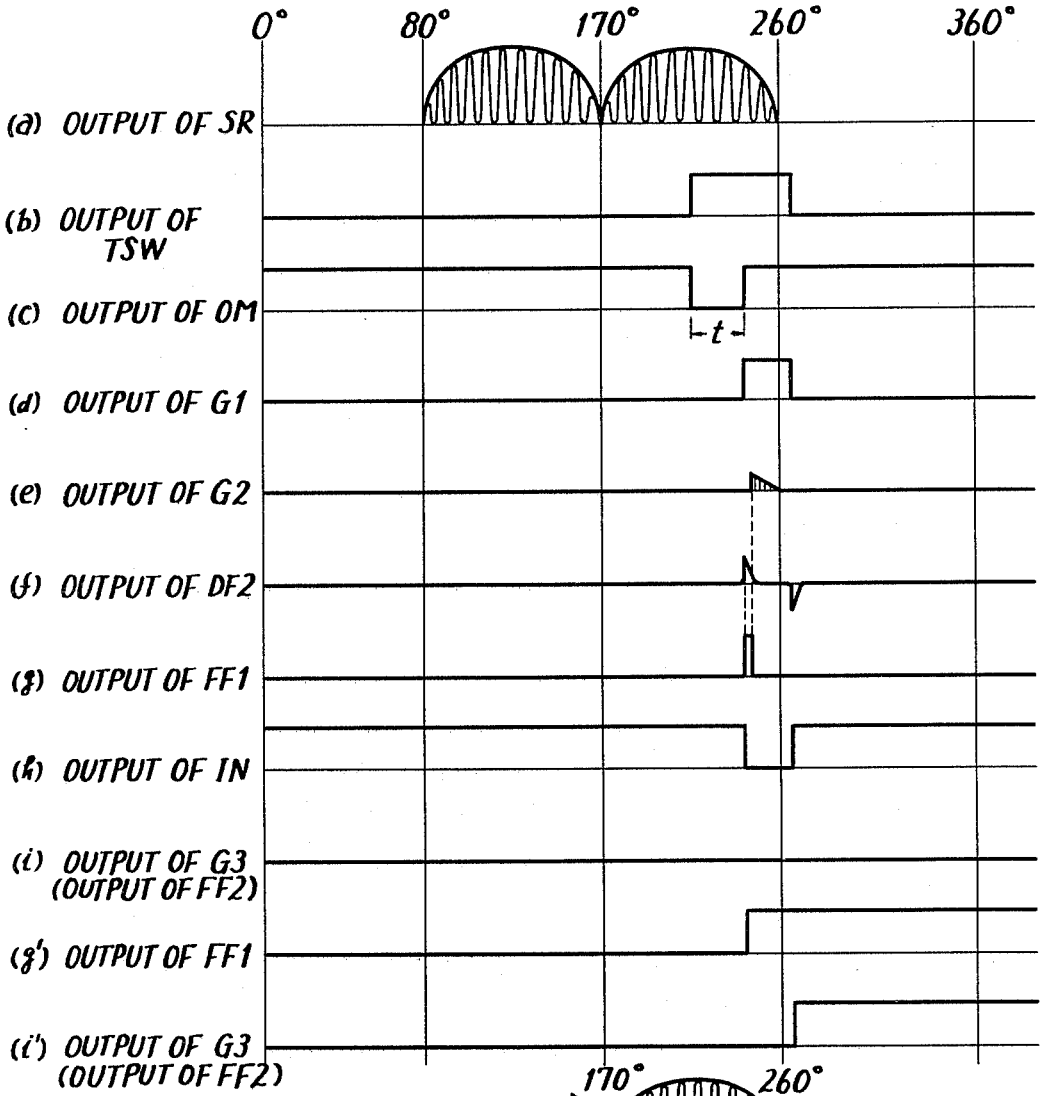
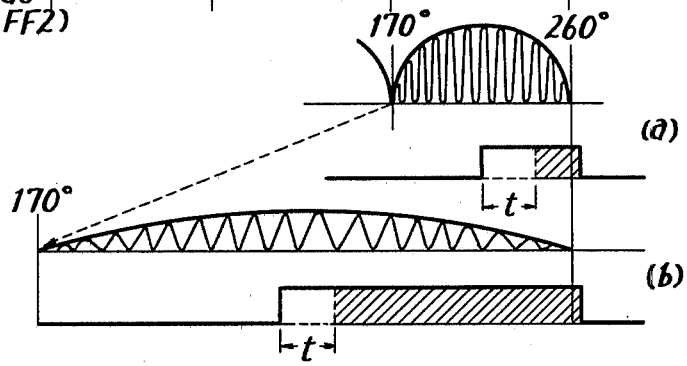
FIG. 5

WOOF BREAKAGE DETECTION SYSTEM FOR A SHUTTLELESS WEAVING MACHINE

BACKGROUND OF THE INVENTION

1. Field of the Invention

The present invention relates to an apparatus for monitoring the condition of the woof in a weaving machine. More specifically, the present invention relates to such an apparatus in a shuttleless weaving machine adapted to detect the breaking of the woof and to automatically stop the weaving machine.

2. Description of the Prior Art

Recently, weaving machines of the shuttleless type, wherein the woof is fed by means of a carrier, an air stream, or the like, while being yielded from a supply, have been put in practical use to replace the more conventional type automatic weaving machines, wherein the woof is fed by the use of shuttles. A variety of apparatuses have been proposed and used for detecting the breakage of the woof in shuttleless weaving machines to cause automatic stoppage whenever a break is detected. A typical prior art apparatus employs a system for detecting the state of tension of the woof by a mechanical means such as a micro switch, dropper or the like adapted to be in contact with the woof. Another type of apparatus employs a piezoelectric detector, to provide an electrical signal representative of the breaking of the woof, by detecting the mechanical vibration of the woof. Photoelectric and electrostatic detection systems, and the like, have also been proposed and put in practical use. However, none of the above described prior art detection systems utilize generation, termination or variation of a monitoring signal in a given range of the weaving cycle of the weaving machine. Therefore, since the prior art systems continually monitor the woof from the start to the end of the travel of the woof, they are liable to cause an erroneous indication of a malfunction, because the woof tends to loosen when the woof is yielded from its supply package making the tension of the traveling woof non-uniform.

For the purpose of preventing the above described erroneous indication of a malfunction, ideally it would be preferable to select the timing for detecting the woof as immediately after the complete insertion of the woof in the warp. However, at that time the travel of the woof is terminated and no signal for detecting the travel vibration of the woof is obtained. Therefore, the ideal timing is not practical for all monitoring modes.

Another problem encountered in the continued monitoring of the woof occurs, since the traveling speed of the woof varies and at midway through the warp comes to a halt before resuming its travel completely through the warp. Therefore, detecting the vibration of woof results in a discontinuous signal over the weaving cycle. Assuming that electrical sensitivity of the woof vibration detection circuit is enhanced in such a manner for monitoring the woof immediately before the woof is completely inserted, it follows that a pseudo woof monitoring signal may be obtained which is caused by noise, and the like. Therefore, even if the woof has broken, it will not be reliably detected. The prior art apparatus, therefore, has been adapted to utilize a detecting range of 5 through 30 centimeters before the end of the fully inserted woof length within the range where stable detection is possible. Such a stable detecting range is largely dependant on the thickness, the roughness, the twisting, the number of twists, the tension and the like of the woof. In any event, the prior art apparatuses for detecting the breaking of the woof within such a stable detecting range have shortcomings in that woof breakage which occurs subsequent to the 5 through 30 centimeter monitoring range is not detected. In order to eliminate such shortcomings, it is necessary to change the relative position where the monitoring means is mounted for mechanically detecting for breakage in the stable detecting range so as to fully monitor the complete length of woof extending through the warp for each weaving cycle of the weaving machine.

SUMMARY OF THE INVENTION

Briefly described, the inventive system for detecting the breaking of woof in a shuttleless weaving machine wherein the woof is fed while being yielded from a supply package comprises a detector circuit for detecting the breaking of the woof, a timing switch for generating a timing signal at a predetermined time period prior to termination of the travel of said woof in association with each weaving cycle of said shuttleless weaving machine, a time period defining circuit responsive to the timing signal for adjustably defining the time period of the operation of the woof breaking detector circuit, and a control circuit responsive to the output from said woof breaking detector circuit for turning off the shuttleless weaving machine when woof breakage is detected.

Therefore, a principal object of the present invention is to provide a system for detecting the breakage of woof in a shuttleless weaving machine which is of a relatively simple structure, wherein the breakage of the woof is detected with accuracy up to a point immediately before the woof is completely inserted in the warp, irrespective of the difference in the kinds of the yarn, thereby to achieve the most immediate control of the weaving machine.

Another object of the present invention is to provide a system for detecting the breakage of woof in a shuttleless weaving machine, wherein the breaking of the woof can be detected with high accuracy even in the case of a low speed operation of the weaving machine.

These and other objects, features, aspects, and advantages of the present invention will become more apparent from the following detailed description of the preferred embodiment of the present invention made in conjunction with the accompanying drawings.

BRIEF DESCRIPTION OF THE DRAWINGS

FIG. 2 shows the structure of one embodiment of a timing switch TSW for use in the present invention;

FIG. 3 is a schematic diagram of a control circuit of an embodiment of the present invention;

FIG. 4 shows various waveforms associated with the operation of the FIG. 3 circuit; and FIG. 5 shows a timing chart of the detection range to compare a normal speed operation and a slow speed operation.

DESCRIPTION OF THE PREFERRED EMBODIMENTS

Figure 1:
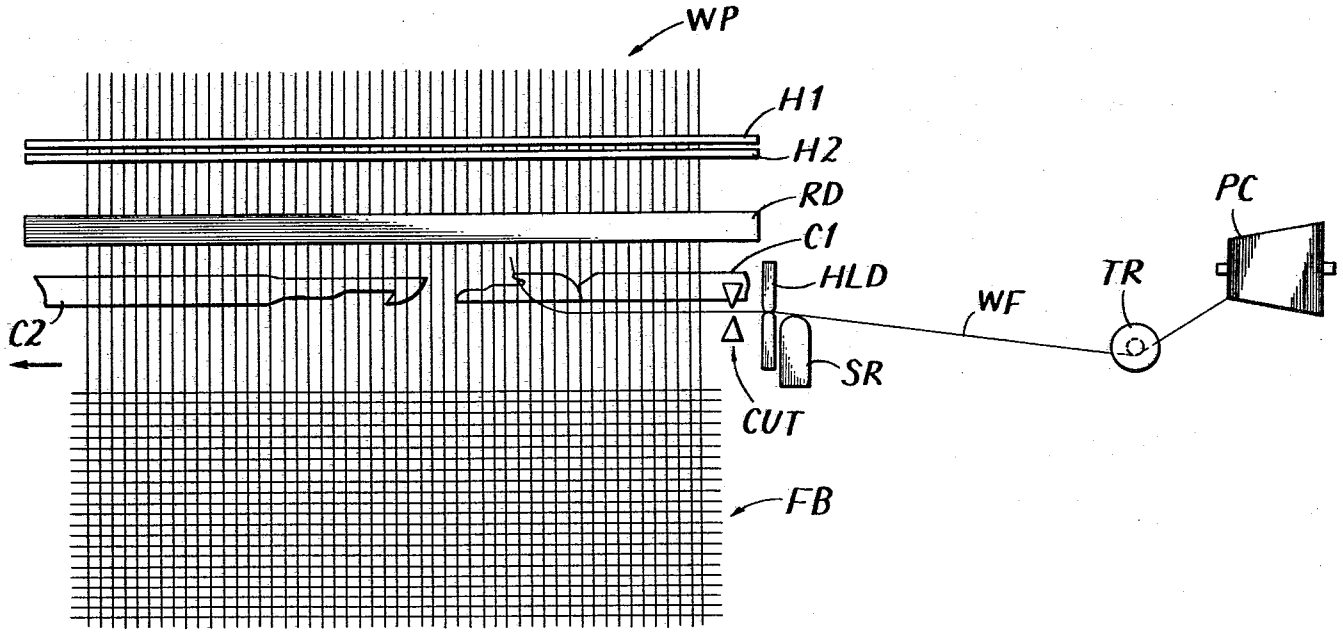
FIG. 1 shows the general structure of a shuttleless weaving machine employing an embodiment in accordance with the present invention.

FIG. 1 is a diagram showing the structure embodiment of a shuttleless weaving machine in accordance with the present invention. Referring to FIG. 1, the woof WF is fed from a supply package PC toward a carrier C1, such that the woof WF is lightly held by a holder HLD while a tension is applied to the woof WF by means of a tension roller TR and the woof WF is brought in contact with a sensor SR for detecting vibration of the woof. The woof WF is fed through the holder HLD, past a cutter CUT and is then gripped by means of the carrier C1, which serves to relay the end of the woof WF to another carrier C2 at the intermediate position of the warp WP. Thus, the woof WF is transferred through the warp WP by means of the carriers C1 and C2.

The warp WP is shedded alternately by means of heddles H1 and H2, while the fabric FB is woven and advanced by the reciprocating movement of a reed RD. These heddles H1 and H2 and the reed RD are operatively associated with a crank shaft (not shown) such that the transfer of the woof through the warp, the shedding timing and the reed timing are determined and synchronized thereby.

During a single weaving cycle, by way of an initial state, the woof WF is released from the supply package PC, is transferred therefrom over the tension roller TR, past the sensor SR to the holder HLD where it is held thereby. The leading end of the woof WF is cut at the position of the cutter CUT and is held thereby.

The warp WP is then shedded by means of the heddles H1 and H2. Accordingly, the leading end of the woof WF is drawn by means of the carrier C1 and is made to travel between the shedded warp WP. When the carrier C1 reaches the intermediate position of the weaving width, the woof WF is relayed to the other carrier C2. Thus, the woof WF is caused to travel from the right end to the left end, as viewed in FIG. 1, of the weaving width through the shedded warp WP. When the leading end of the woof WF reaches the left end of the weaving width, the cutter CUT operates to cut the woof WF at the position of the cutter. Since at that time the carriers C1 and C2 have been made to return to their respective initial positions outside of the weaving width, the reed RD is then moved in front of the weaving region and the reed operation is effected to thereby complete the weaving cycle which corresponds to one revollution of the aforementioned crank shaft.

FIG. 2 is a view showing the structure of a timing switch TSW, wheerein FIG. 2(*a*) shows a perspective view thereof and FIG. 2(*b*) shows a side view thereof. The timing switch TSW includes a fan shaped vane portion FN, serving as a shutter, provided on a rotatable shaft SH; and a switch for generating an electrical signal, such as an oscillation type contactless switch OS for detecting passage of the fan shaped vane portion FN therethrough. The shaft SH is connected to the above described crank shaft, such that the shaft SH is synchronously rotated in the arrow direction as the crank shaft rotates in a one to one relationship. The contactless switch OS is provided at a predetermined position and may comprise an oscillator and a receiver provided to face each other such that the vane FN passes between the oscillator and the receiver in a contactless manner as the shaft SH rotates, thereby to change the coupling between the oscillator and the receiver to provide an on/off signal in association with the rotation of the vane FN. More specifically, the contactless switch TSW is structured such that as the vane FN is rotated due to the rotation of the shaft SH the switch TSW provides a high level signal by way of a timing signal only when the vane FN passes between the oscillator and the receiver. The weaving machine performs one weaving cycle during each rotation of the shaft SH, as described in conjunction with FIG. 1. The width of the vane FN and its position with respect to the shaft SH are properly selected to provide the timing signal at a desired time with respect to the weaving cycle. Alternatively, the timing switch TSW may comprise, in place of the oscillator type contactless switch OS, a photo-electric switch which utilizes a light source and a photo detector, such that the vane FN moves between them, as the shaft rotates, and interrupts the light beam from the light source to the photo detector to provide an on/off signal in association with the rotation of the fan FN.

FIG. 3 is a schematic diagram of a control circuit of an embodiment of the present invention. The output *b* from the timing switch TSW is applied to a differentiation circuit DF1 and is also applied to one input of an AND gate G1. The output from the differentiation circuit DF1 is applied to a monostable multivibrator OM. The monostable multivibrator OM is configured to include a variable resistor, for adjustment of its RC time contant, for the prupose of defining a time gating period to detect the breaking of the woof in a desired range. Alternatively, a delay circuit may be used which is capable of adjusting the delay time thereof, as desired. The output *c* from the monostable multivibrator is applied to the other input of the AND gate G1. The output *d* from the AND gate G1 is applied in parallel to one input of an AND gate G2, to a differentiation circuit DF2 and to an inverter IN. The output of the differentiation circuit DF2 is fed to the set input of a flip-flop FF1 and the output of the inverter IN is fed to one input of an AND gate G3. The other input of the AND gate G2 is supplied by the output *a* from a sensor SR through an amplifier AM. The output *e* from the AND gate G2 is applied through an OR gate G4 to the reset input of the flip-flop FF1. The set output *g* from the flip-flop FF1 is applied to the other input of the AND gate G3. The output *i* from the AND gate G3 is applied to the set input of the flip-flop FF2. The set output of the flip-flop FF2 is applied to the base of a transistor Q for relay controlling the power to the wearing machine and disabling the same when woof breakage is detected. The collector of the transistor Q is supplied with the supply voltage +V through a relay coil L. The reset input of the flip-flop FF2 is supplied with the source voltage +V through a power reset push button PB. Similarly, the reset input of the flip-flop FF1 is supplied, through the OR gate G4, with the source voltage through the power reset push button PB.

FIG. 4 shows waveforms at various locations in the FIG. 3 circuit for the purpose of explaining the operation thereof. Specifically described, FIG. 4(*a*) shows the output from the sensor SR for detecting vibration of the woof at the time of travel of the woof, FIG. 4(*b*) shows the output from the timing switch TSW, FIG. 4(*b*) shows the output from the monostable multivibrator OM, FIG. 4(*d*) shows the output from the AND gate G1 defining the detection timing, FIG. 4(*e*) shows the output from the AND gate G2, FIG. 4(*f*) shows the output from the differentiation circuit DF2, FIG. 4(*g*) shows the output from the flip-flop FF1 during a time when the woof is detected as being present, FIG. 4(*g'*) shows the output from the flip-flop FF1 at a time when the woof is detected as being broken, FIG. 4(*h*) shows the output from the inverter IN, FIG. 4(*i*) shows the output from the AND gate G3 during a time when the woof is detected as being present, and FIG. 4(*i'*) shows the output from the AND gate G3 at a time when the woof is detected as being broken.

Referring to FIG. 4(*a*), the woof WF is adapted to travel through the shedded warp WP during the phase angle of approximately 80° to 260° in terms of the weaving cycle and the crank shaft rotation, with a single stop when the woof is relayed from the carrier C1 to the carrier C2 at the approximate intermediate position or at the phase angle of 170° for the purpose of making it possible to detect the woof, irrespective of the kind of yarn, within the range of the position of the woof. The position of mounting the vane FN with respect to the shaft and the width of the vane FN are selected such that the timing switch TSW provides a timing signal to cover a cycle phase and corresponding crank shaft angle interval of 235° to 260° and until slightly thereafter, since the most accurate detection of the woof is possible before the travel of the woof is terminated, and the position of the woof where the speed of the carrier C2 becomes highest, in the cycle phase period between 235° and 260°.

In addition, in order to make the start position of detection of the woof variable, depending on the kind of yarn, the monostable multivibrator OM is adapted to provide a disabling pulse to the gate G1 with a delay time period determinable by the above described RC time constant starting from the rise time of the pulse obtained from the timing switch TSW, as shown in FIG. 4(*c*). Accordingly, the monostable multivibrator OM in the FIG. 3 circuit is provided with a variable resistor for the purpose of desired adjustment of the time constant.

Description is now made of the operation of the FIG. 3 circuit with simultaneous reference to FIGS. 1 through 4. First of all, the operation of the apparatus in the case where the woof has not broken is described. As the shaft SH is rotated in synchronization with the rotation of the crank shaft of the weaving machine, while the carrier C2 pulls the woof WF gripped thereby, the vane FN passes the position of the contactless switch OS. At that time, the timing switch TSW generates the timing signal *b*, as shown in FIG. 4(*b*), defining the range of the most stable detection. The timing signal *b* is differentiated by the differentiation circuit DF1 to be applied to the monostable multivibrator OM. The monostable multivibrator OM responds thereto and produces a low level disabling output signal *c* with a delay time *t* from the rise of the signal *b*, which time *t* is commensurate with the RC time constant determined by the variable resistor and an associated storage capacitor of the multivibrator. At the end of the delay time *t*, the output signal *c* becomes a high level to enable the AND gate G1 to gate through the remainder of the output pulse from the timing switch TSW. Therefore, the AND gate G1 provides a coincidence output *d*, as a function of the signal *b* and the enabling output signal *c*, to define the timing for detecting breakage of the woof. The output *d* from the AND gate G1 is differentiated by the differentiation circuit DF2 and the resultant triggering signal, corresponding to the rise thereof, serves to set the flip-flop F1. The output *d* from the AND gate G1 further serves to enable the AND gate G2 and to disable the AND gate G3 through the inverter IN.

The sensor SR detects the vibration of the woof WF as it is drawn thereover. The detected vibration signal *a* is amplified by the amplifier AM and is applied to the AND gate G2. The output from the AND gate G2 resets the flop-flop FF1. Accordingly, if the woof WF has not broken, the flip-flop FF1 is reset after a short time period, as shown in FIG. 4(*g*). The low level output *d* from the AND gate G1 is inverted by the inverter IN to be a high level signal *h*, which is applied to the AND gate G3. In this case though, the AND gate G3 provides a low level output signal *i*, since no woof breakage is detected and the flip-flop FF1 is immediately reset by the output of G2.

Now the operation of the apparatus is described in the case where the woof has broken. When the output pulse *b* is obtained from the timing switch TSW, the flip-flop FF1 is set, as described previously. Since the woof has broken, the sensor SR does not detect vibration of the woof yarn and no output is obtained therefrom. Therefore, the AND gate G2 is disabled and does not provide the reset output *e*. Accordingly, the flip-flop FF1 remains in the set state by the output of the differentiation DF2, without being reset, as is seen in FIG. 4(*g'*). The set output *g'* from the flip flop FF1 enables the AND gate G3. When the vane FN passes the position of the contactless switch OS the output signal *b* from the timing switsh TSW goes to the low level, whereby the AND gate G1 switches to a low level output *d*. The low level output *d* from the AND gate G1 is inverted to a high level by the inverter IN, which is applied to the enabled AND gate G3. Accordingly, the AND gate G3 provides the woof break detected output *i'*, to set the flip-flop FF2. Since the set output from the flip-flop FF2 controls the transistor Q to be conductive, the relay coil L is energized. As the relay coil L is energized, the relay contact thereof (not shown) is actuated to be opened, and the weaving machine is thereby controlled to be stopped. Preferably, an alarm, a display and the like (not shown) may be provided which are responsive to the energization of the coil L to indicate the breaking of the woof.

When the weaving machine is controlled to be stopped and the same is notified to an operator, the operator remedies the broken woof yarn and depresses the power reset push button PB, thereby resetting the flip-flops FF1 and FF2. Therefore, the weaving machine is again brought to an operating condition and continues to operate in the usual normal manner until a further breaking of the woof is detected.

A slow speed operation in the embodiment shown is now considered. Referring to FIG. 5, FIG. 5(*a*) shows a timing chart of the detection range in a normal speed operation, and FIG. 5(*b*) shows a timing chart of the detection range in a slow speed operation, for example, the speed of (*b*) is as slow as one third of the normal operation. Since the vane VN provided on the said timing switch TSW is rotated in synchronization with the cycle speed of the weaving machine, the output from the timing switch TSW in case of the slower operation has a cycle time period determined as being defined mechanically in association with the operation speed, as shown in FIG. 5(*b*). On the other hand, the monostable multivibrator OM serves to provide a delay of a predetermined time period *t* from the rise time point of the output *b* from the timing switch TSW. Therefore, the detectable timing range, i.e., the portion shown as hatched in FIG. 5, of the output from the AND gate G1 is prolonged. In other words, the detection range is broadened and the output signal from the sensor can be withdrawn in the phase where the output from the sensor SR is much less attenuated, i.e., the phase in the vicinity of the middle portion of the phase range of 170° to 260°, with the result that detection of the breaking of the woof is still possible although the output from the sensor SR is significantly smaller due to the slower operation.

Several advantages, as described in the following, are realized by the specific features of the embodiment shown and described. Since the most reliable detection range of the breaking of the woof has been adapted to be defined mechanically by the mounting angle of the fan shaped vane portion of the timing switch TSW and the best detection range, immediately before the termination of the travel of the woof, is adapted to be adjusted within the most reliable detection range by means of the delay time of the monostable multivibrator, the most reliable detection of the breaking of the woof is therefore made possible within the best detection range. Furthermore, since the detection range can be set as desired through adjustment of the delay time of the monostable multivibrator OM, the detection range can be selected by a mere manual operation of a control knob connected to the variable resistor in accordance with the kind of the yarn. The breaking of the woof is detectable until immediately before the travel of the woof is terminated. Therefore, the detection accuracy is enhanced and accordingly the reliability of the apparatus is increased.

Considering again the case where the operation speed is lowered, wherein the embodiment shown has been structured such that the detection range is determined by the vane FN in direct association with the phase angle of the weaving cycle of the weaving machine and a portion of that detection range is cancelled for a predetermined delay time of the monostable multivibrator OM, the detection range is broadened as the speed of the weaving cycle is lowered. Therefore, even if the output signal from the sensor becomes smaller as the operation speed is lowered, the detection range is automatically broadened enough to detect the output from the sensor. Accordingly, it has been shown that the apparatus can be used at different speeds, without adversely affecting the woof breaking detection system.

Although this invention has been described and illustrated in detail, it is to be clearly understood that the same is by way of illustration and example only and is not to be taken by way of limitation, the spirit and scope of this invention being limited only by the terms of the appended claims.

I claim:

1. A system for detecting the breaking of woof as it is fed to a shutterless weaving machine during each weaving cycle of said machine, comprising:

means for monitoring the movement of said woof as it is fed into said weaving machine and producing a signal indicative thereof;

means for pulling said woof in said weaving machine during each said weaving cycle;

means for producing a timing signal at a predetermined phase point of each said weaving cycle;

means connected to said monitoring means and said timing signal producing means for determining, after a predetermined amount of time following the beginning of said timing signal, any non-movement of said woof during said timing signal and producing a break signal indicative thereof;

said determining means including a means for receiving said timing signal and producing a disabling signal for said predetermined amount of time after the beginning of said timing signal and an enabling signal after said predetermined amount of time;

means connected to said disabling/enabling signal producing means and to said timing signal producing means for gating the remainder of said timing signal following said predetermined amount of time;

means connected to receive said monitoring means movement signal for gating said remainder timing signal to produce an unbroken woof signal; and means connected to receive said unbroken woof signal and said remainder timing signal for defining a break determining time period following the beginning of said remainder timing signal and producing said break signal when said unbroken woof signal does not occur during said break determining time period.

2. A system as in claim 1, wherein said pulling means pulls said woof during two separate phase portions of each said cycle and wherein said timing signal producing means produces a timing signal beginning at a first predetermined phase point of the second one of said phase portions and extends to a second predetermined phase point of said cycle beyond the termination of said second phase portion.

3. A system as in claim 2, wherein said timing signal producing means is a switching mechanism having a rotating portion synchronized to rotate during said weaving cycle at a rate of one revolution per cycle, and having a portion thereof defining said occurrence of said timing signal over a predetermined angle of revolution of said revolving element corresponding to said first and second predetermined phase points.

4. A system as in claim 1, wherein said monitoring means is a piezo electric element mounted on said weaving machine so that said pulled woof contacts said element and said element produces an alternating electric signal due to the vibration of said woof as it is pulled across said element.

5. A system as in claim 1, wherein said woof movement monitoring means comprises means for detecting vibration of the woof as it is pulled by said pulling means.

6. A system as in claim 1, wherein said timing signal producing means comprises means operatively coupled to said weaving machine for providing said timing signal over a predetermined phase period of said weaving cycle.

7. A system as in claim 1, wherein said timing signal producing means comprises:

means provided to be movable in synchronization with said weaving cycle of said weaving machine;

means responsive to said movable means for detecting the relative location of said movable means and for providing said timing signal;

said movable means being structured such that said timing signal is of a predetermined phase period with respect to said weaving cycle of said weaving machine.

8. A system as in claim 7, wherein said weaving machine includes a shaft rotating in synchronization with said weaving cycle of said weaving machine, said movable means includes a detectable element mounted on said shaft for defining said predetermined phase period of said weaving cycle and said detecting means is positioned with respect to said detectable element for producing said timing signal to begin at said predetermined phase point over said predetermined phase period.

9. A system as in claim 8, wherein said detecting means includes a contactless switch which is close-open responsive to the proximity of said detectable element.

10. A system as in claim 8, wherein said detecting means includes a photoelectric sensor and a light source, and said detectable element is an opaque fan shaped vane extending from said shaft so as to be rotatable between said light source and said photoelectric sensor.

11. A system as in claim 1, wherein said disabling-/enabling signal producing means includes means for adjusting said predetermined amount of time.

12. A system as in claim 11, wherein said adjusting means comprises means responsive to the beginning of said timing signal for defining the end point of said predetermined amount of time period.

13. A system as in claim 1, wherein said disabling-/enabling signal producing means comprises a monostable multivibrator connected to be responsive to the leading edge of said timing signal.

14. A system as in claim 13, wherein said monostable multivibrator includes a variable time constant circuit which is used to select the end point of said predetermined amount of time.

15. A system as in claim 1, further including means responsive to said break signal for stopping the operation of said weaving machine.

16. A system as in claim 15, wherein said stopping means includes means for restarting said weaving machine.

* * * * *

UNITED STATES PATENT AND TRADEMARK OFFICE

CERTIFICATE OF CORRECTION

PATENT NO. : 4,095,621

DATED : June 20, 1978

INVENTOR(S) : ARAO KAKINAKA

It is certified that error appears in the above-identified patent and that said Letters Patent are hereby corrected as shown below:

[30] "51-16085" should be --51-16805--;
Col. 3, line 43, "revollution" should be --revolution--;
Col. 3, line 45, "wheerein" should be --wherein--;
Col. 4, line 21, "prupose" should be --purpose--;
Col. 6, line 19, "flip flop" should be --flip-flop--;
Col. 6, line 22, "switsh" should be --switch--;
Col. 7, line 49, "shutterless" should be --shuttleless--.

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*